US006029487A

United States Patent [19]

Genin et al.

[11] Patent Number: 6,029,487

[45] Date of Patent: Feb. 29, 2000

[54] SYSTEM AND METHOD FOR MANUFACTURING TUBULAR PRODUCTS FROM TUBULAR WORKPIECES

[75] Inventors: Dmitry Genin, Bat-Yam; Lev Lyahovetsky, Lod, both of Israel; Robert Heifets, Dnepropetrovsk, Ukraine

[73] Assignee: Avmat Kydroforming Ltd., Hefer, Israel

[21] Appl. No.: 09/139,085

[22] Filed: Aug. 24, 1998

[51] Int. Cl.[7] ..... B21D 39/20

[52] U.S. Cl. ..... 72/58; 72/62

[58] Field of Search ..... 72/57, 58, 60, 72/61, 62

[56] References Cited

U.S. PATENT DOCUMENTS

| | | | |
|---|---|---|---|
| 2,203,868 | 6/1940 | Gray et al. | 72/62 |
| 4,761,982 | 8/1988 | Snyder | 72/58 |
| 5,097,689 | 3/1992 | Pietrobon | 72/58 |
| 5,732,732 | 3/1998 | Gross et al. | 137/318 |

FOREIGN PATENT DOCUMENTS

| | | | |
|---|---|---|---|
| 0754900A1 | 1/1997 | European Pat. Off. | 41/6 |
| 2679159A1 | 1/1993 | France | 5/4 |
| 22423 | 2/1980 | Japan | 72/58 |
| 199530 | 12/1982 | Japan | 72/61 |
| 82229 | 5/1985 | Japan | 72/58 |
| 1433527 | 10/1988 | Japan | 72/53 |
| 245940 | 10/1989 | Japan | 72/58 |
| 763017 | 9/1980 | U.S.S.R. | 72/58 |
| 916010 | 3/1982 | U.S.S.R. | 72/58 |
| 1176994 | 9/1985 | U.S.S.R. | 72/58 |

*Primary Examiner*—David Jones

*Attorney, Agent, or Firm*—Davidson, Davidson & Kappel, LLC

[57] ABSTRACT

A system for forming tubular metal products from tubular workpieces by hydroforming achieving single-step radial expansion of 70–150% with high dimensional accuracy. Enhanced single-step radial expansion is achieved by maintaining a predetermined functional relationship among the driving parameters of the hydroforming process and by increasing the plasticity of the workpiece by employing the fractional deformation effect and by applying ultrasound oscillations and alternating angular strains to the workpiece.

19 Claims, 11 Drawing Sheets

A - A

A - A

SYSTEM AND METHOD FOR MANUFACTURING TUBULAR PRODUCTS FROM TUBULAR WORKPIECES

FIELD OF THE INVENTION

The present invention relates to the manufacture of complex shape tubular metal products from pipes without using welding or machining.

BACKGROUND OF THE INVENTION

Complex shape tubular metal products may be manufactured using casting, welding, or pipe hydroforming.

Casting and welding are nearly always labor and energy intensive. In addition, when there are dimensional accuracy and quality standards, these methods require additional finishing and testing operations.

In hydroforming, a hollow tubular workpiece is confined in a die with its inner surface corresponding to the desired outer surface of the part to be produced. Punches or rams are pressed axially against the ends of the workpiece and fluid at great pressure is introduced therein via one of the punches. The combined axial compression of the punches and the internal pressure of the fluid cause the workpiece to expand to fill the die cavity, producing the desired part.

However, radial expansion of a workpiece by applying a high hydraulic pressure to its interior using existing hydroforming methods and equipment, creates tensile stresses in the workpiece material, whereby the resistance to deformation of the workpiece material increases considerably as it is deformed. This is known as work hardening and results in a reduction in plasticity of the workpiece material and in a thinning of the wall of the expanded portion of the workpiece. It can further result in breakage of the wall of the expanded portion beyond a specific limiting expansion ratio. This limits the amount of radial expansion that can be achieved with existing hydroforming methods in a single step of expansion; for example, steels typically are limited to 30–40%, while electrolytic coppers typically are limited to 50–70%. This restricts the variety of products that can be produced without employing multiple hydroforming steps. An additional problem is that the deformation is irregular, resulting in variations in the wall thickness in the part produced, often beyond acceptable standard tolerances.

U.S. Pat. No. 5,097,689 and French patent number 2679159 disclose attempts to improve on the basic hydroforming process by means of a separate hydraulic cylinder (patent FR2679159) or with special rigid inserts (U.S. Pat. No. 5,097,689). To achieve larger radial expansion, intermediate steps of heat treatments are proposed. These, however, add considerably to the complication and cost of the production process. Neither of these patents address the limits to one-step deformation without additional annealing steps or the problem of dimensional accuracy in the basic hydroforming process.

SUMMARY OF THE INVENTION

The present invention seeks to provide a system and method for manufacturing tubular metal products of desired shape and dimensions via hydroforming achieving single step radial expansion of 70–150% and with dimensional accuracy and surface quality corresponding to those of the initial workpiece.

There is thus provided, in accordance with a preferred embodiment of the invention, a system for forming tubular metal products from tubular workpieces by hydroforming including:

a base;

a split die which, when closed, defines a cavity with a shape corresponding to the shape of a tubular metal product desired to be formed;

a enclosing frame including a central portion arranged generally parallel to the axis of the workpiece and two lateral portions generally transverse thereto;

a clamping device mounted on the central portion of the enclosing frame operative to hold together the split die with at least a predetermined force;

two setting mechanisms, each mechanism being mounted on a preselected one of the two lateral portions of the enclosing frame symmetrically about the die and coaxially with the workpiece, each including a hydraulic setting cylinder and a setting punch, and, further, each operative to apply a setting force via the setting punch to an end of a tubular workpiece mounted in the die;

a hydraulic fluid for filling and transferring a pressure to the interior of the workpiece;

at least one hydraulic pressure amplifier operative to apply a pressure, by means of the hydraulic fluid, to the interior of the tubular workpiece via a central axial cavity in at least one of the setting mechanisms;

control apparatus operative to determine and control the setting force and the pressure, varying them in a predetermined manner, while the desired tubular product is being formed, maintaining a predetermined functional relationship between the setting force and the pressure; and a hydraulic power unit operative to activate the hydraulic setting cylinders and the at least one hydraulic pressure amplifier;

wherein the inward-facing surface of each of the setting punches is operative, when the setting force is applied thereby, to sealingly engage an end of the tubular workpiece mounted in the die so as to prevent loss of pressure of the pressurized hydraulic fluid via the ends of the workpiece.

In an alternative embodiment of the invention, the system further includes an oil bath wherein at least part of the die, and the entire interior of the workpiece, are immersed in the oil bath.

For the case wherein the desired tubular product and hence, the cavity of the die, has extending therefrom at least one cylindrical branch protruding from the axis of the workpiece, the system further includes, for each branch, a hydraulic support cylinder and support punch operative to apply a support force to the workpiece as it is deformed into the branch while the desired tubular product is being formed; and the control apparatus further controls and determines the support force, which is also included in the predetermined functional relationship.

The control apparatus is further operative, while the desired tubular product is being formed, to periodically reduce and increase the pressure, the setting force, and, if there are branches, the support force, while maintaining the functional relationship thereamong, with a periodicity in the frequency range of 3–5 Hz, and wherein the reduction is of a magnitude in the range of 20–50% of the respective magnitudes of the pressure and the forces before reduction.

Further in accordance with a preferred embodiment of the present invention, the system includes torsion apparatus, which may be an electromagnetic, hydraulic, or pneumatic angular actuator, to apply alternating angular strains to the ends of the tubular workpiece of predetermined magnitude and frequency via the setting punches and wherein the inward-facing surfaces of the setting punches further are operative to grip the ends of the tubular workpiece so as to apply the angular strains thereto. These angular strains are of a magnitude of at least 1 degree but no greater than 2 degrees in each direction and of a frequency in the range of 5–10 Hz.

Still further in accordance with a preferred embodiment of the present invention, the system includes an ultrasound generator and at least one ultrasound transducer with a concentrator mounted in touching contact with either the die or the setting punches or both, so as to apply ultrasonic oscillations of a frequency in the range 17–35 kHz, power of a magnitude less than 10 kW, and an amplitude in the range 0.1–14.0 microns thereto and thereby, to the workpiece.

In an alternative embodiment of the invention, the system may include a mandrel mounted axially in the workpiece with an external diameter substantially matching the internal diameter of the workpiece.

In a further alternative embodiment of the invention, the cavity in the die has a predetermined curvature operative to compensate for variations in the wall thickness of the tubular product desired to be formed and to ensure thereby uniformity of the internal diameter thereof.

There is also provided, in accordance with a preferred embodiment of the invention, a method for forming tubular metal products from tubular workpieces by hydroforming system including the steps of:

placing a hollow workpiece of a predetermined length within a split die;

applying a sealing pressure to ends of the workpiece;

applying a hydraulic pressure to the interior of the workpiece;

applying an axial setting force to the ends of the workpiece;

maintaining a predetermined functional relationship between at least the hydraulic pressure and the setting force;

periodically varying at least the hydraulic pressure and the setting force, while maintaining the functional relationship therebetween, at a periodicity in the frequency range of 3–5 Hz, wherein the step of varying includes the step of reducing, for a predetermined interval, the hydraulic pressure and the setting force linearly by a magnitude in the range of 20–50% of the respective magnitude of the hydraulic pressure and the setting force before the step of varying, followed by the step of increasing the hydraulic pressure and the setting force linearly to predetermined magnitudes above the respective magnitudes of the hydraulic pressure and the setting force before the step of varying, wherein the step of applying an axial setting force further includes the step of maintaining a sealing pressure on the ends of the workpiece, and wherein the steps of applying a hydraulic pressure, applying an axial setting force, and maintaining are performed substantially simultaneously.

For the case wherein a tubular metal product desired to be formed has at least one branch extending transversely therefrom, the method also includes the step of applying to the at least one branch a support force as the at least one branch deforms from the workpiece, so as to prevent undesired thinning of the branch walls, and wherein the step of maintaining includes maintaining a predetermined functional relationship between the hydraulic pressure, the axial setting force, and the support forces and the step of varying includes varying the hydraulic pressure, the axial setting force, and the support forces.

In accordance with an alternative embodiment of the present invention, the method further includes, before the step of applying a sealing pressure, the step of immersing the workpiece in an oil bath.

Further in accordance with a preferred embodiment of the present invention, the method further includes the step of applying alternating angular strains to the ends of the tubular workpiece of predetermined angular magnitude of at least 1 degree but no greater than 2 degrees and with a predetermined periodicity in the range of 5–10 Hz.

In accordance with a further preferred embodiment of the present invention, the method further includes the step of applying ultrasonic oscillations of a frequency in the range 17–35 kHz, power of a magnitude less than 10 kW, and an amplitude in the range 0.1–14.0 microns to the workpiece.

BRIEF DESCRIPTION OF THE DRAWINGS

The present invention will be more fully understood and appreciated from the following detailed description taken in conjunction with the drawings, in which.

DETAILED DESCRIPTION OF THE INVENTION

Figure 1:
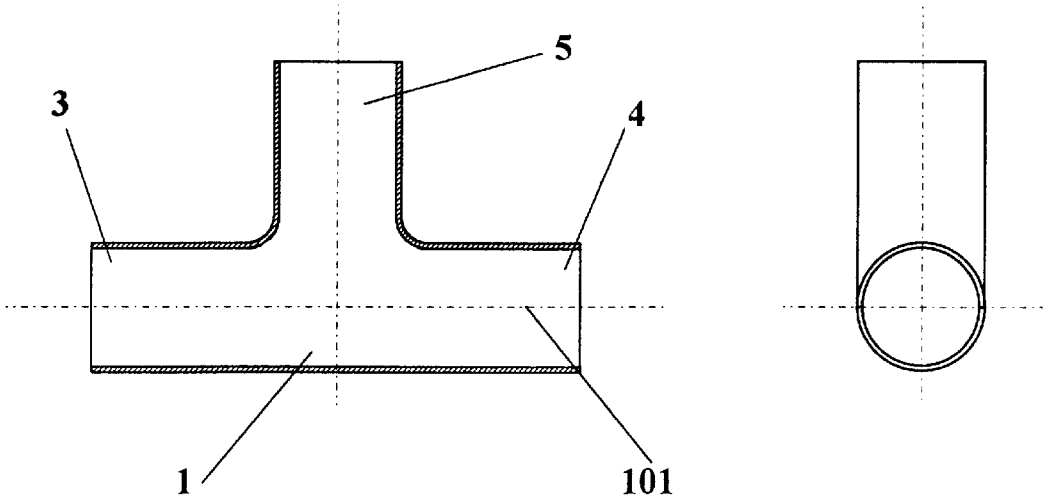
FIG. 1 is an example of a tubular product it is desired to be formed.
Figure 2:
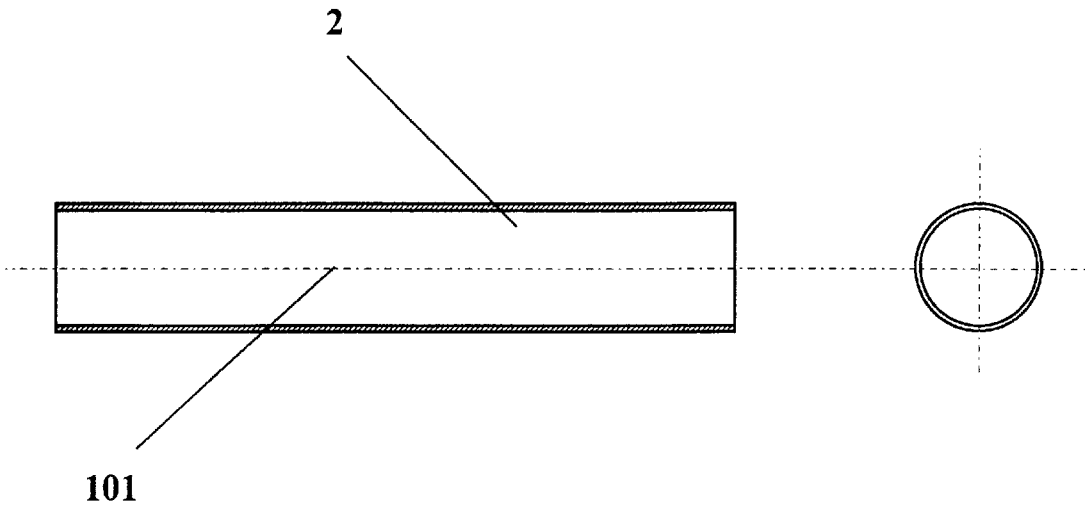
FIG. 2 is a workpiece from which a tubular product is to be formed.
Figure 13A:
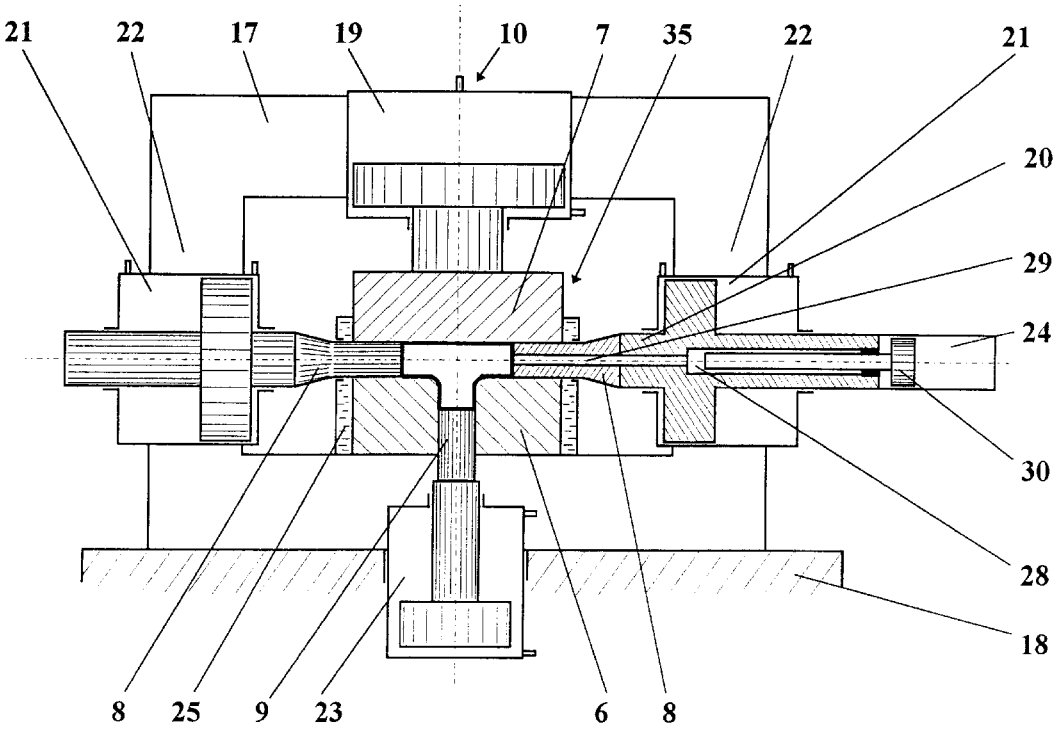
FIG. 13A is hydroforming system for forming tubular metal products from tubular workpieces, constructed and operative in accordance with a preferred embodiment of the present invention.

Referring now to FIG. 13A, there is shown a hydroforming system for forming tubular metal products from tubular workpieces referred to generally as 10, constructed and operative in accordance with a preferred embodiment of the present invention. Hydroforming system 10 includes enclosing frame 17, mounted on base 18, which encloses a split die, referred to generally as 35, which has two portions 6 and 7 which close to form a cavity or impression with the shape of a tubular metal product desired to be formed. Strictly by way of example, in the present embodiment, the tubular metal product to be formed, referred to hereinafter as the "product," is tee shaped. Referring briefly to FIGS. 1 and 2, there are shown, respectively, the product 1 and the tubular workpiece 2 of the present example. Product 1 has a single cylindrical portion 5 branching transversely from the workpiece axis 101.

It should be understood that the tee-shaped product shown in FIGS. 1 and 13A is given strictly by way of example, and that the present invention may be employed to produce tubular products of many shapes and sizes, such as various pipe fittings, with single or multiple branches, or with no branches, such as pipe reducers, cam shafts, or more complex hollow bodies.

Returning now to FIG. 13A, the two portions, 6 and 7 of die 35 are clamped together with a predetermined force by hydraulic cylinder 19 mounted on the central portion of enclosing frame 17. This clamping may be accomplished by any mechanism providing the required clamping force; hydraulic cylinder 19 is shown strictly by way of example.

Enclosing frame 17 has two lateral portions 22, on each of which is mounted a setting mechanism including a hydraulic cylinder 21 and a setting punch 8. Setting punches 8 extend into die 35 to engage the ends of the workpiece therein and apply thereto a setting force, $F_{set}$, produced by cylinders 21.

In the present embodiment, an internal hydraulic pressure, $P_{int}$, is applied to the interior of the workpiece by hydraulic pressure amplifier 24, which has a driving cylinder 30 and a high pressure chamber 28, via a central cavity 29 in one of setting punches 8. Pressure amplifier 24 applies the internal pressure via a suitable hydraulic fluid which fills amplifier 24 and the interior of the workpiece. In alternative embodiments of the present invention, the system may include two pressure amplifiers, each of which is mounted on its respective setting cylinder, or a single stationary pressure amplifier pressurizing the interior of the workpiece via one or both setting punches and a suitably configured, flexible, high-pressure hose. It is the internal pressure, $P_{int}$, combined with the setting force, $F_{set}$, that drives the deformation of the workpiece to conform to the shape of the cavity of die 35 to produce product 1. Clearly, the internal pressure must not escape the interior of the workpiece, so setting punches 8 must also seal the ends of the workpiece so as to contain the internal pressure, $P_{int}$, therein.

In the present embodiment, system 10 further includes an oil bath 25 which ensures that the workpiece and pressure amplifier 24 are always filled with oil or hydraulic fluid during the hydroforming process and between processing cycles. In accordance with a preferred embodiment of the present invention, the workpiece is immersed in oil bath 25 to a level sufficient to ensure that its interior is totally filled with oil or hydraulic fluid. This prevents any penetration of air into these internal pressurized spaces, which, as will be understood by persons skilled in the art, interferes with the hydroforming process.

In the present embodiment of the present invention, the system further includes a hydraulic support cylinder 23 and support punch 9 which apply a support force, $F_{sup}$, to the workpiece as it is deformed into the branch of the cavity of die 35 while the desired tubular product is being formed. This serves to prevent breakage of the wall at the end of the branch and to counteract undo thinning of the walls of the branch itself as a result of the deformation. It should be clear, however, that additional support cylinders and punches may be included, with different locations and orientations than those shown in FIG. 13A, depending on the number and orientation of branches in the product it is desired to be formed.

Figure 3:
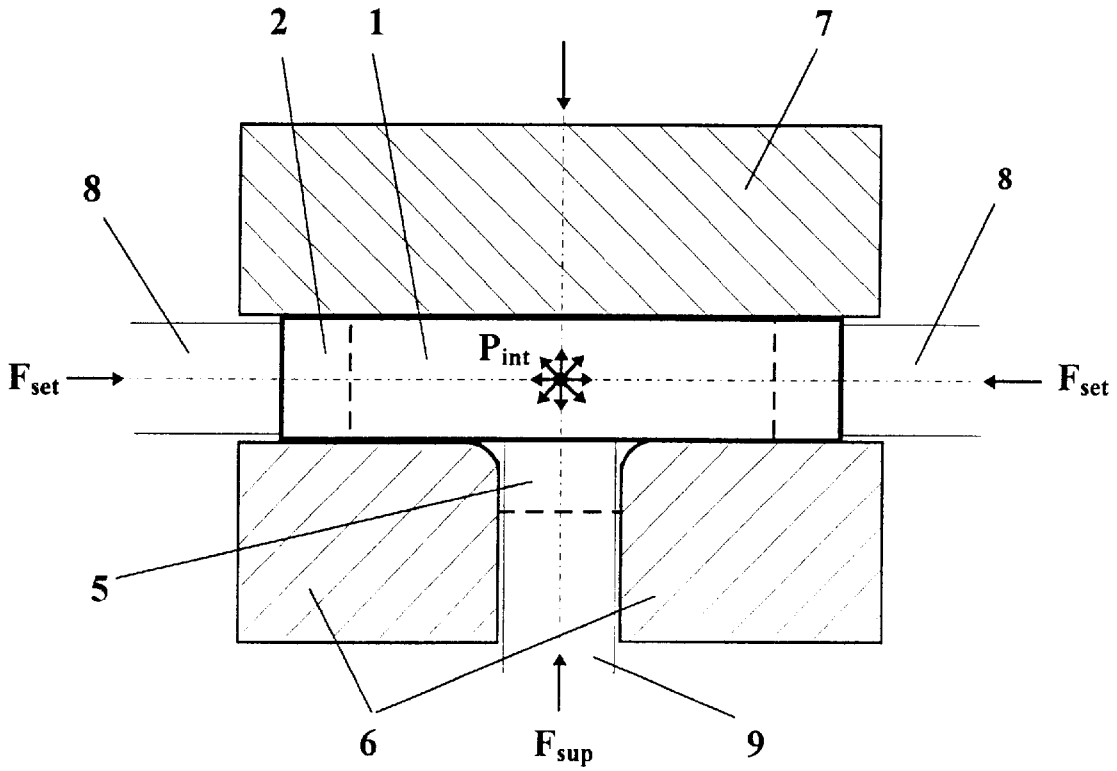
FIG. 3 is a schematic representation of the pressure and forces applied to the workpiece during the hydroforming process using a system constructed and operative in accordance with a preferred embodiment of the present invention.
Figure 13B:
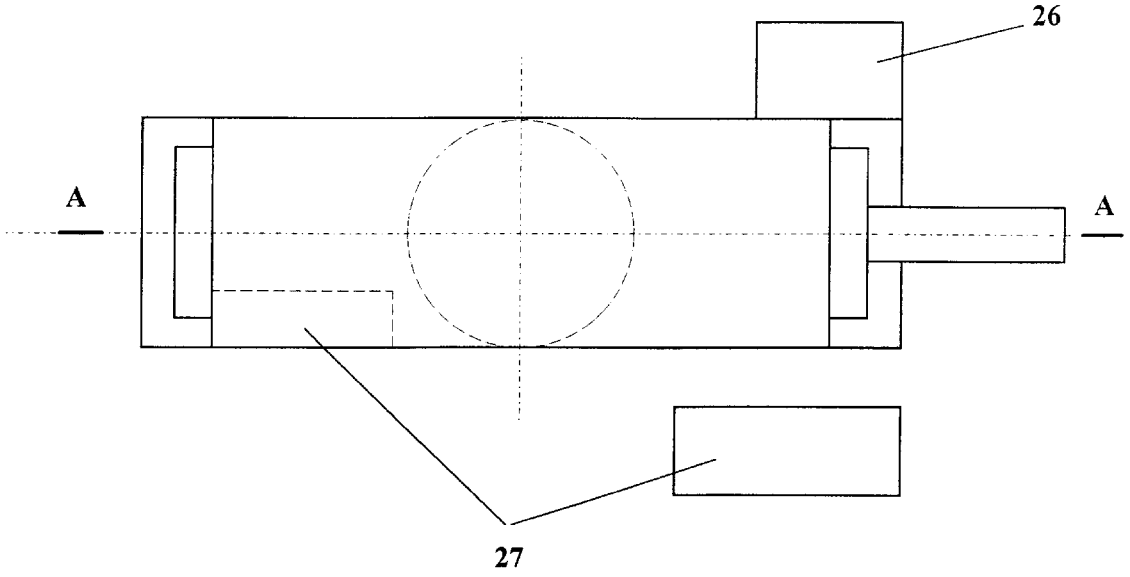
FIG. 13B is a schematic top view of the system of FIG. 13A including a hydraulic power unit and control system.

Referring now to FIG. 3, there are shown schematically the forces and pressures applied to the workpiece 2 as it is deformed into product 1 (broken line). As will be explained below, in accordance with the method of the present invention, these will all need to be varied during the course of the hydroforming process. To this end, referring briefly to FIG. 13B, there is shown schematically, a hydraulic power unit 26 operative to activate all the hydraulic components producing the forces and pressures and a control system 27 including a data processor and suitable servo units operative to set and control, via hydraulic power unit 26, the forces and pressures, varying them in a desired manner during the course of the hydroforming process. The locations of hydraulic power unit 26 and control system 27 in FIG. 13B are given strictly by way of example; any functional configuration may be used.

Figure 4:
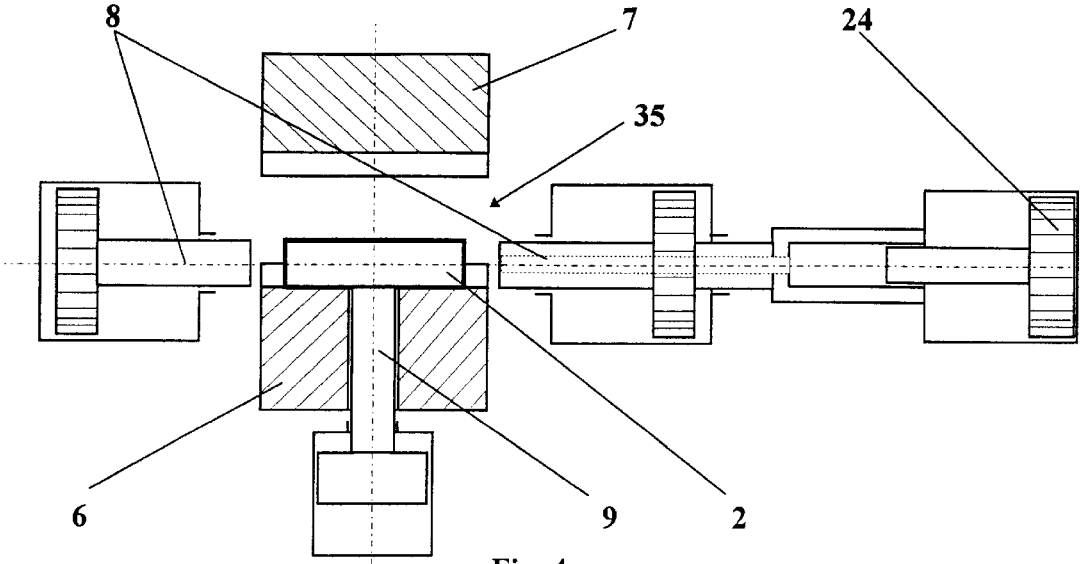
FIGS. 4, 5, and 6 are simplified representations of the steps in hydroforming using a system constructed and operative in accordance with a preferred embodiment of the present invention.
Figure 5:
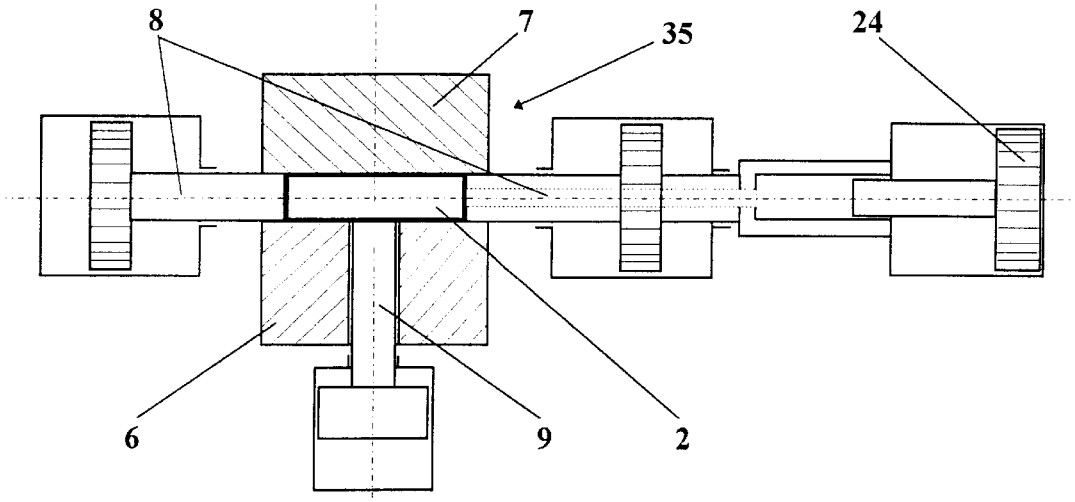
Figure 6:
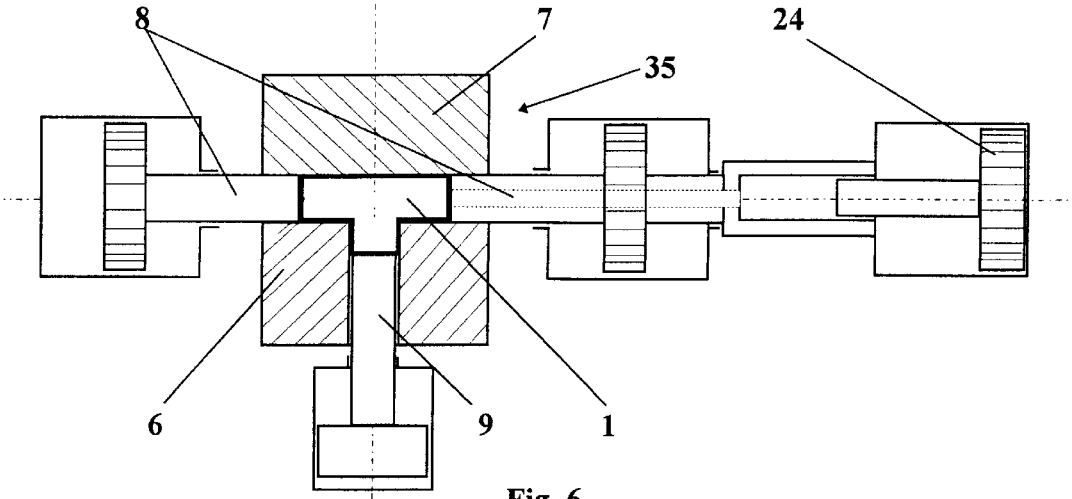

Referring now to FIGS. 4, 5, and 6, there are shown, in accordance with the method of the present invention, schematically, the steps in the hydroforming process for a tee shaped product, in accordance with a preferred embodiment of the present invention. In FIG. 4, portions 6 and 7 of die 35 are separated and setting punches 8 are pulled apart to allow workpiece 2 to be inserted into die 35. Support punch 9 is raised to the level of the surface of the workpiece 2. FIG. 5 shows the start of the hydroforming process wherein setting punches 8 contact the ends of the workpiece 2 to hermetically seal its interior by applying a sealing pressure thereto. This stage of the process occurs immediately prior to applying the driving pressure and forces to the workpiece. In FIG. 6, the hydroforming process has been completed. Setting punches 8 are separated by a distance equal to the length of the final product, and support punch 9 has been displaced by a distance equal to the required branch height.

To produce the product from the workpiece, the workpiece must undergo a plastic deformation to form the branch. This requires redistribution of the metal of the workpiece and the feeding thereof into the maximum plastic deformation zone, namely, the branch, which causes the workpiece to shorten accordingly. Since, as will be understood by persons skilled in the art, the metal of the workpiece hardens as it is worked or deformed, the internal hydraulic pressure, $P_{int}$, must increase during the deformation process. The setting force, $F_{set}$, must increase accordingly to maintain the sealing of the workpiece to retain the pressure therein, to axially deform the workpiece, and to overcome the friction force between the workpiece and the die. The combined action of the internal hydraulic pressure, $P_{int}$, and the setting force, $F_{set}$, cause the workpiece shorten and deform into the branch of the die impression. However, as will be understood by persons skilled in the art, when a certain branch height is reached, typically 15% to 30% of the outer diameter of the workpiece, the wall at the end of the branch breaks as it gets too thin to contain $P_{int}$. To obtain a greater branch height, the support force, $F_{sup}$, supplied by support cylinder 23 and support punch 9 reduces the tensile stress in the wall of the branch and creates compression stress in its top to reinforce it against breakage.

In accordance with a preferred embodiment and with the method of the present invention, in order to increase the obtainable branch height beyond the known limitations of the prior art, the aforementioned driving parameters of the hydroforming process: $P_{int}$, $F_{set}$, and $F_{sup}$, are varied during the course of the hydroforming process while preserving the following functional relationship thereamong:

$$1.6\ P_{int}(D-2t)^2-(F_{sup}+\xi F_{set})\approx 0$$

wherein:

$P_{int}$ is the pressure applied to the interior of the workpiece, $F_{sup}$ is a weighted average sum of the support forces for all branches, weighted by the effective areas of the respective support cylinders, which is equal to the aforementioned $F_{sup}$ for the present example of a tee with one branch and is equal to zero for the case of no branches and hence, no support force, $F_{set}$ is the setting force, $\xi$ is a shape factor which varies linearly in time from a predetermined value, depending on the shape and mechanical properties of the desired tubular product material, to a value in the range of 1.1–1.4 of the predetermined value, as the desired tubular product is being formed, D is the outer diameter of the workpiece, and t is the wall thickness of the workpiece.

Over the course of the hydroforming process the internal hydraulic pressure, $P_{int}$, varies from zero to a maximum value, $P_{intmax}$, which may be calculated based on the geometry of the product and the mechanical properties of the material of which it is formed, most importantly, the work hardening, or resistance to further deformation, resulting from the cumulative deformation. For the present example of a tee fitting, $P_{intmax}$ may be determined from the following formula:

$$P_{intmax}\geqq 1.13\sigma(1+t/d)$$

wherein:

$\sigma$ is the yield point of the workpiece metal considering its work hardening toward the end of the formation process, t is the branch wall thickness, and d is the branch outer diameter.

The range of values for the support force, $F_{sup}$, is typically based on the following considerations. The minimum or starting value for $F_{sup}$ must be great enough to prevent thinning of the branch wall, but not so great as to prevent the deformation required to form the desired branch. The maximum value for $F_{sup}$ is achieved at the end of the hydroforming process and depends on the tensile stress produced in the branch wall by the internal hydraulic pressure. In practice, the optimum minimum value has been found to be in the range of 0.5 to 0.6 of the maximum value.

Figure 7:
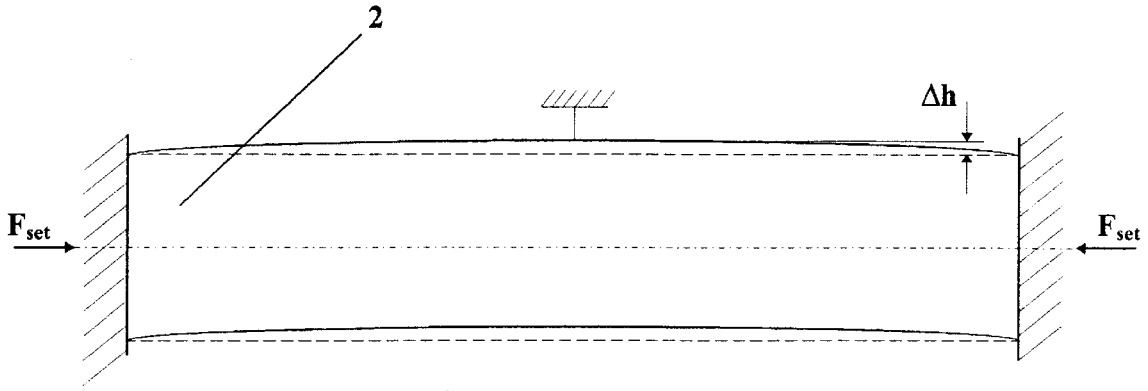
FIG. 7 is a schematic representation of the effect of the dimensional tolerance of the die impression on the setting force magnitude.

The setting force, $F_{set}$, must always be great enough to seal the workpiece against the force of the internal hydraulic pressure, $P_{int}$. It must, at the same time, never exceed the longitudinal rigidity of the workpiece. Another consideration is the dimensional tolerance of the die impression in relation to the outer diameter of the workpiece. This is shown schematically in FIG. 7, wherein $\Delta h$ is a maximum possible deflection of the workpiece 2, which is equal to half the difference between the workpiece outer diameter and the corresponding die impression diameter. As will be understood by persons skilled in the art, the smaller $\Delta h$ is, the larger will be the allowable setting force. The setting force will reach its maximum value at the end of the hydroforming process.

In accordance with a preferred embodiment of the present invention, control system 27 (FIG. 13B) is operative to reduce, for predetermined intervals during the course of the hydroforming process, the internal hydraulic pressure, $P_{int}$, and then, to continue to increase its value. As will be understood by persons skilled in the art, the aforementioned work hardening effect is the result of internal stresses in the body of the material of the workpiece produced as a result of the deformation process, which limits the obtainable deformation and hence, the obtainable branch height. By periodically reducing the internal hydraulic pressure, $P_{int}$, in accordance with a preferred embodiment and with the method of the present invention, these internal stresses are released due what is known as the fractional deformation effect, which increases the plasticity of the workpiece material, thereby allowing greater obtainable branch heights without the need for complicated additional processing, such as annealing, as is known in the prior art. With the reduction of the internal hydraulic pressure, $P_{int}$, the setting force, $F_{set}$, and the support force, $F_{sup}$, must also at the same time be reduced accordingly to maintain the aforementioned functional relationship thereamong.

Figure 8:
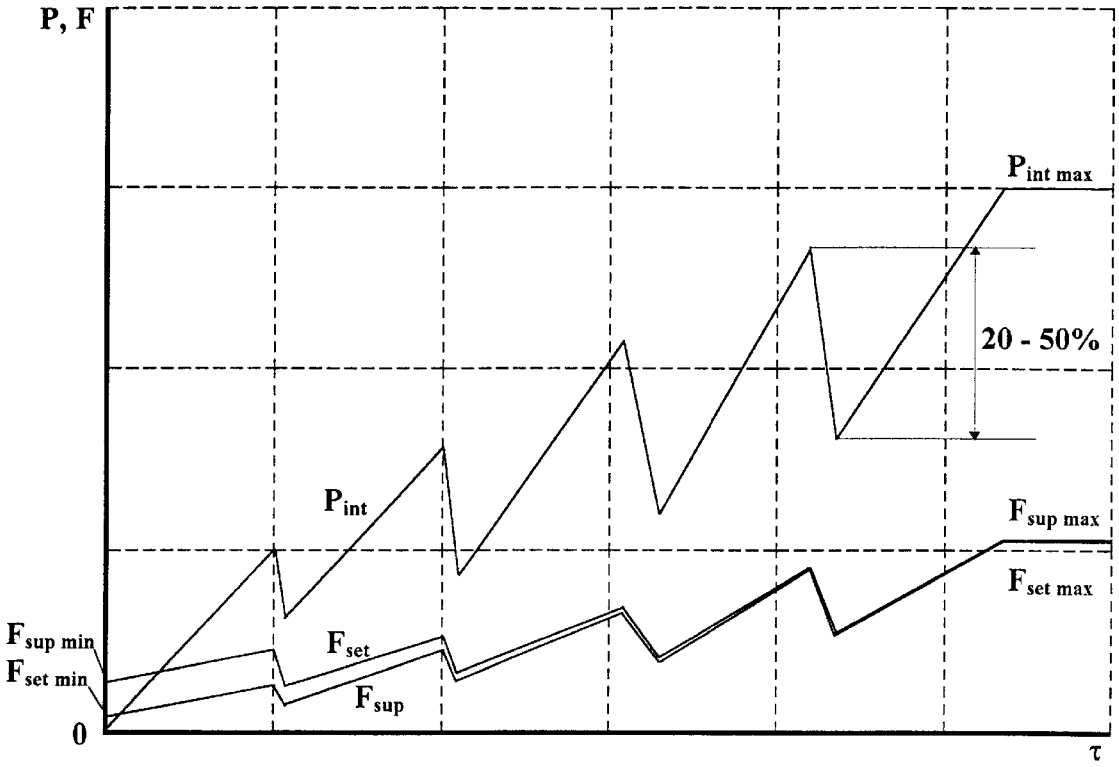
FIG. 8 is a graphical representation of the periodic variations, during the hydroforming process, of the driving parameters thereof: $P_{int}$, $F_{set}$, and $F_{sup}$, in accordance with a preferred embodiment of the present invention.

Referring now to FIG. 8, there is shown a graph representing the periodic variations of $P_{int}$, $F_{set}$, and $F_{sup}$ over the course of a typical hydroforming process in order to obtain the aforementioned fractional deformation effect. The horizontal axis represents the time, $\tau$, during the hydroforming process, and the vertical axis represents the magnitudes of the pressure and forces. It may be seen that the internal pressure, $P_{int}$, is reduced each time by 20% to 50% of the value attained before reduction. This allows optimum reduction of the internal stress of the workpiece material. The periodicity of the pressure and force variations depends on the time required for relaxation of the internal crystal structure and on the deformability of the workpiece material.

In accordance with a preferred embodiment and with the method of the present invention, ultrasonic oscillations are applied to the workpiece during the deformation process, in order to further increase the deformability of the workpiece material. The ultrasonic oscillations introduce vibrations to the internal crystal structure of the workpiece material which serve to release internal stresses therein with similar effect to that of the fractional deformation effect described above. Workpiece plasticity is increased, allowing greater obtainable branch heights for a single deformation step. Effectiveness of ultrasound application depends on the ultrasonic oscillations orientation and on the position of the deformation zone with respect to the oscillatory system. As will be understood by persons skilled in the art, locating the deformation zone in the oscillation tension antinode results in superposition of alternating stresses in the workpiece material, which will maximize the relaxation effect of the ultrasound oscillations precisely where it is most needed. The most effective way of applying the ultrasonic energy to the deformation zone is to apply the oscillations both to the workpiece, which can be via setting punches 8, and to die 35, to which the ultrasonic energy can be applied directly.

An additional advantage of applying ultrasound oscillations is reduction of contact friction between the workpiece and die 35, thereby reducing the required forces. This can be accomplished by locating the shift antinode of the oscillations on the deforming tool, in this case, die 35 and setting punches 8.

Figure 9A:
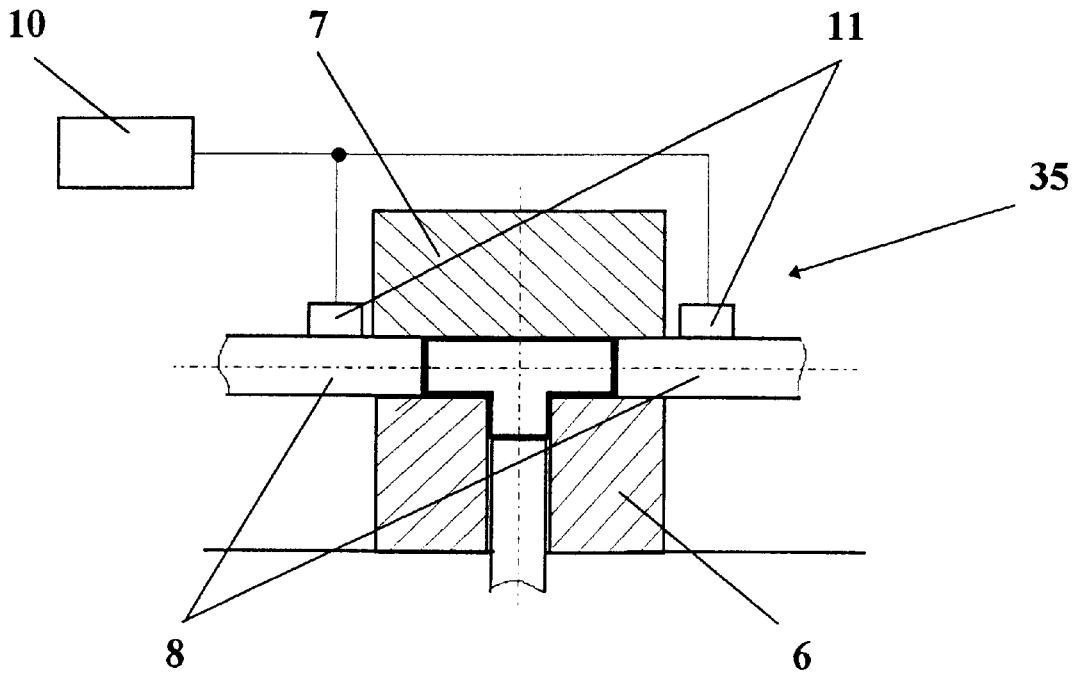
FIGS. 9A and 9B are schematic representations of a portion of a hydroforming system constructed and operative in accordance with alternative embodiments of the present invention which include application of ultrasonic oscillations to the workpiece.
Figure 9B:
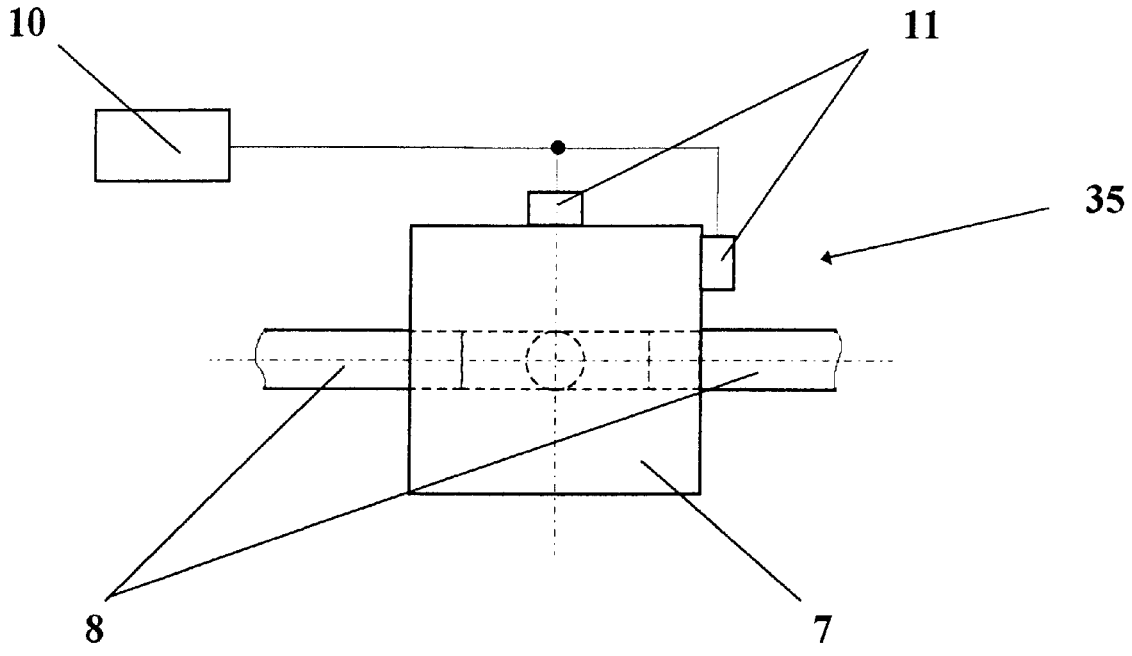

Referring now to FIGS. 9A and 9B, there is shown, a hydroforming system according to a preferred embodiment of the present invention, with the addition, in schematic form, of an ultrasonic generator 10 and ultrasonic transducers 11 to apply ultrasonic oscillations to the workpiece. Further, transducers 11 may include concentrators (not pictured) to concentrate the ultrasound energy applied. In FIG. 9A, transducers 11 are in touching contact with setting punches 8, and in FIG. 9B, transducers 11 are in touching contact with die portion 7. In both examples, ultrasonic oscillations are transferred to the workpiece from transducers 11 via the part in contact therewith. In alternative embodiments of the present invention, transducers may be in touching contact with both setting punches 8 and die 35, or with other parts of hydroforming system 10 to allow transfer of ultrasonic oscillations to the workpiece. Further, it has been found that the ultrasound oscillations are most effective when they are of a frequency in the range 17–35 kHz, power of a magnitude less than 10 kW, and an amplitude in the range 0.1–14.0 microns.

Figure 10A:
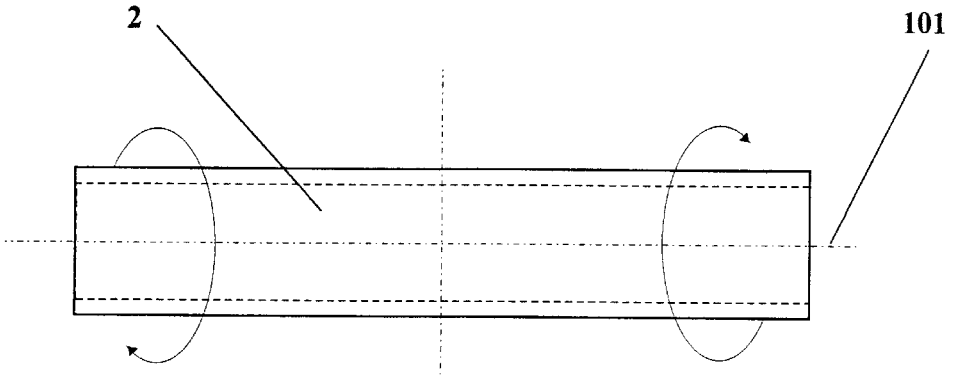
FIGS. 10A and 10B are schematic representations of how angular strains are applied to the workpiece and to the tubular product being formed, respectively, in accordance with a preferred embodiment of the present invention.
Figure 10B:
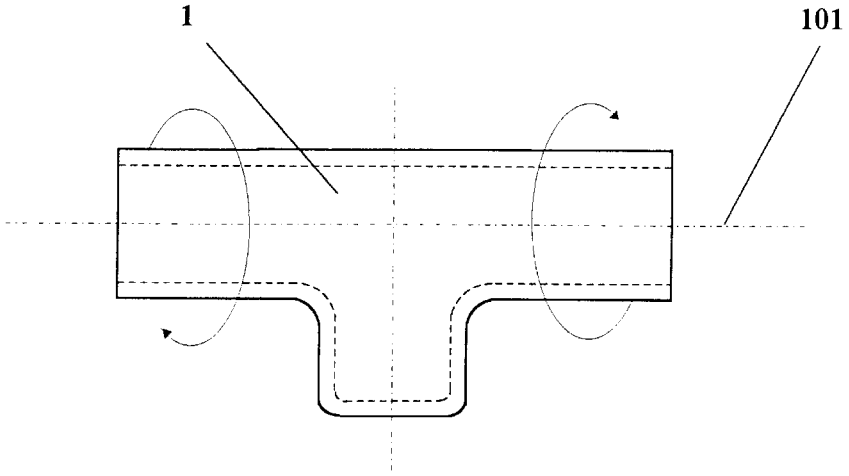
Figure 10C:
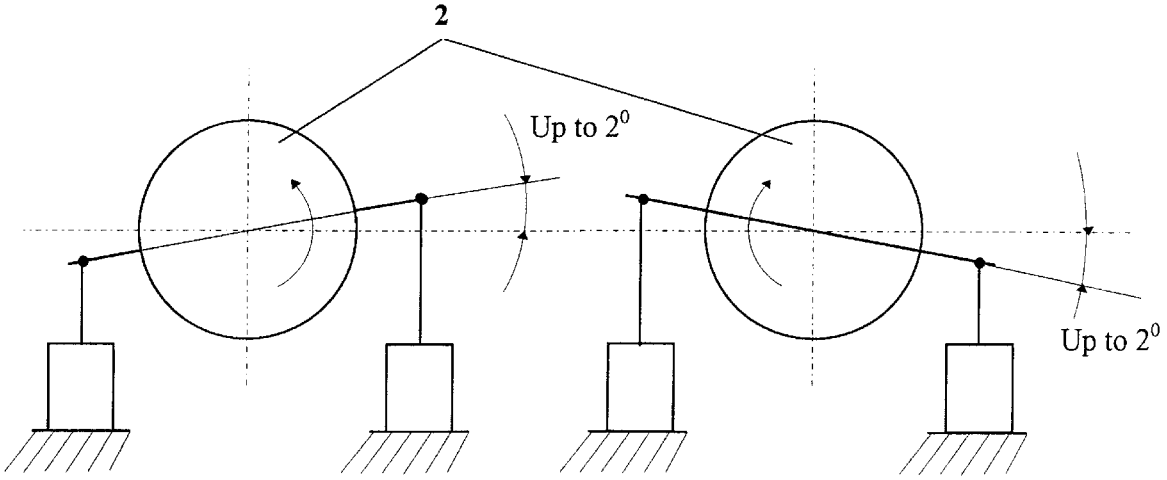
FIG. 10C is a schematic representation of how the angular strains of FIGS. 10A and 10B are applied to the ends of the workpiece.

In accordance with a further preferred embodiment and with the method of the present invention, in order to further release internal stresses within the workpiece material and thereby increase its deformability, alternating angular strains are applied to the workpiece. As shown in FIGS. 10A and 10B, angular strains about axis 101 of the workpiece 2 are induced by deforming the workpiece by rotating the ends of the workpiece in opposite directions by an angle between 1° and 2°, as shown schematically in FIG. 10C. Strains up to 2° applied with a periodicity in the range of 5–10 Hz, are sufficient to induce the desired softening effect. The strains are applied via setting punches 8 and their associated hydraulic cylinders 21 (FIG. 13A) by means of suitable torque generating angular actuators, which may be electromagnetic, hydraulic, or pneumatic.

Figure 11A:
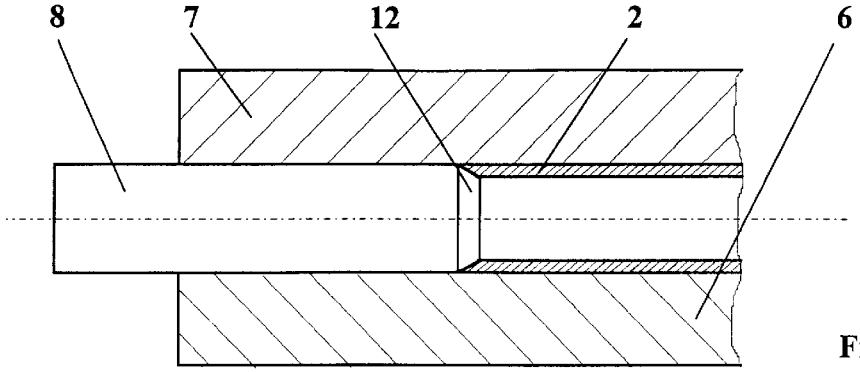
FIGS. 11A through 11G are cross-sectional and detailed views of ways of applying torques to the end of the workpiece.
Figure 11B:
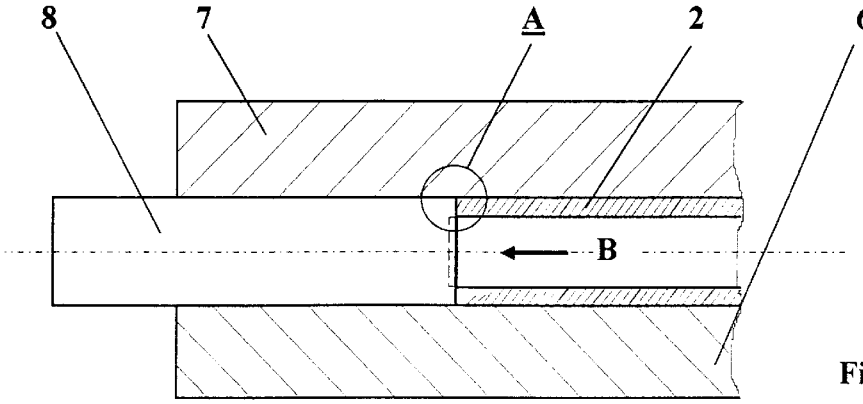
Figure 11C:
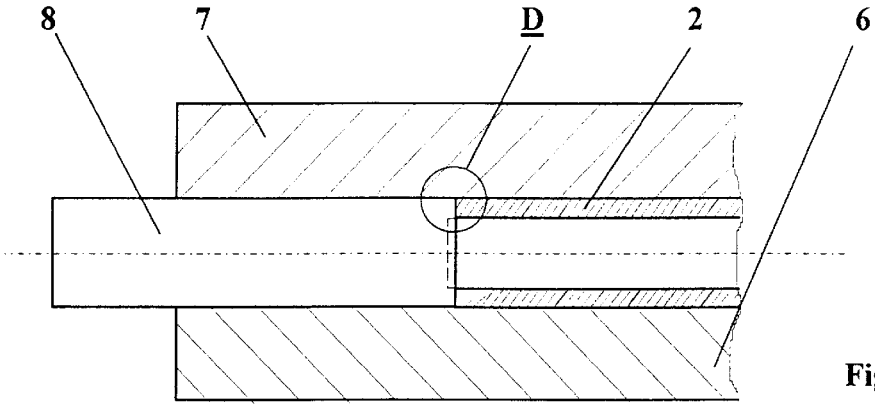
Figures 11D, 11E, 11F, 11G:
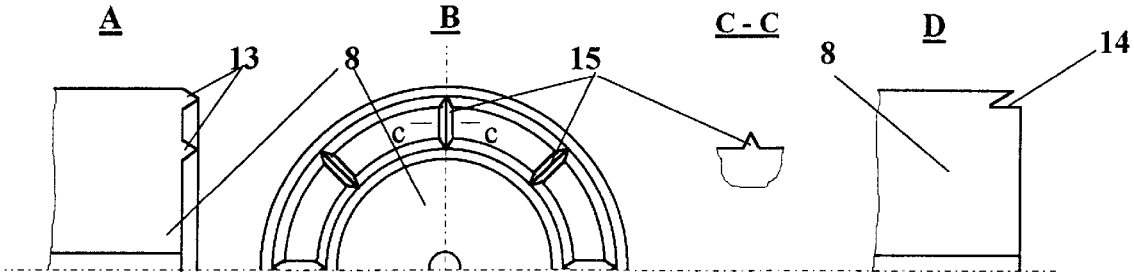

Referring now to FIGS. 11A–11G, there are shown examples of various ways of applying torques to the end of the workpiece 2 via setting punches 8. If the workpiece wall thickness is 3 mm or more, the torque may be applied from punch 8 to the workpiece 2 by friction. As shown in FIG. 11A, the friction surface may be increased, for example, by providing the front end face of the punch with an annular conical chamfer 12. The setting force during the course of the hydroforming process is high enough to provide a frictional force strong enough to allow angular deformation of the workpiece up to 2°. When the wall thickness is less than 2 mm, the friction force between punch 8 and workpiece 2 may be increased, for example, by providing the front end face of punch 8 with annular "forward" 13 or "backward" 14 tooth-shaped projections combined, if necessary, with radial projections 15 having a "forward" tooth shape as shown in the detailed FIGS. 11D–11G. These projections will slightly deform the face of the workpiece to grip it, thereby allowing the torque to be applied thereto, while still sealing the workpiece interior to contain the pressurized hydraulic fluid therein. For workpieces with a wall thickness in the range from 2 to 3 mm, the choice of the abovementioned ways to apply torques thereto will depend on the physical properties of the workpiece material.

The operations described above, which are additions to the hydroforming process as known in the art, serve to increase the deformability of the workpiece material and thereby decrease the magnitude of the pressures and forces required in the hydroforming process. They may be applied individually or in any combination within the scope of the present invention.

Depending on the physical properties of the workpiece material and on the dimensions and configuration of the desired tubular product, deformations in a single processing step of 20% to 50% more than those obtainable using the prior art are obtainable with the present invention.

Figure 12:
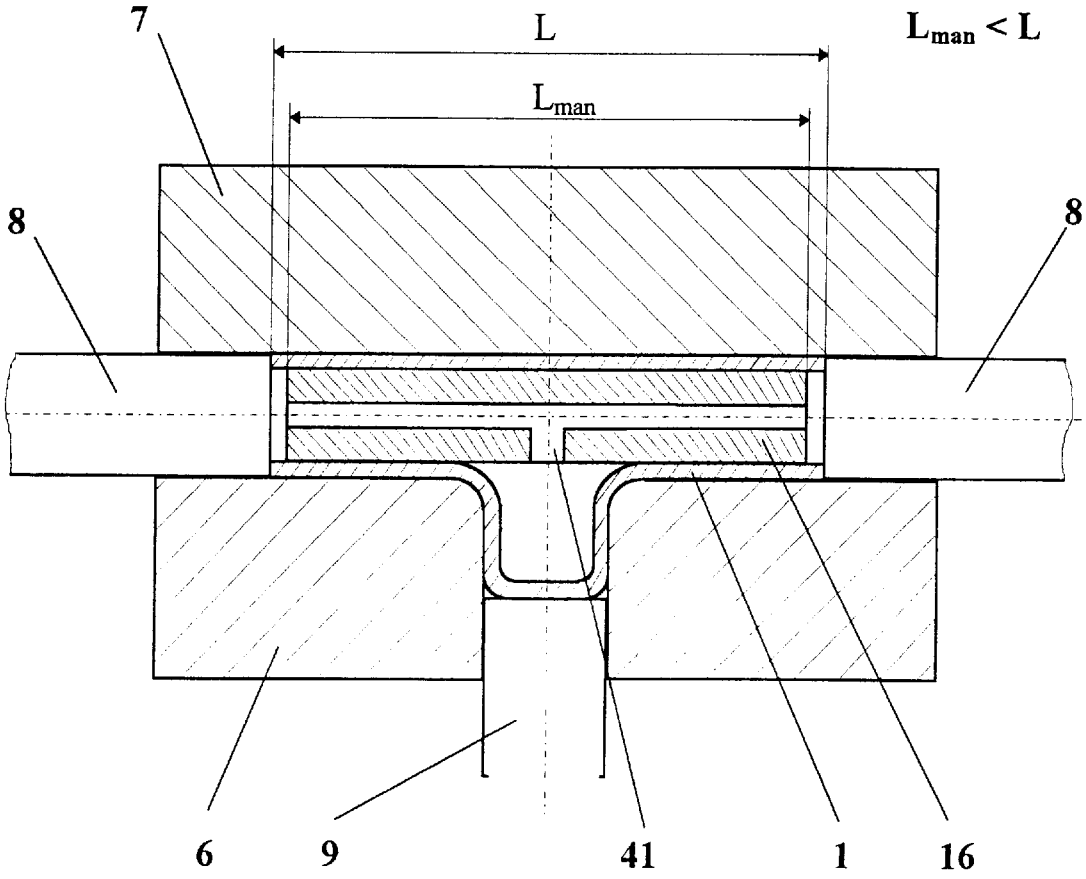
FIG. 12 is a cross-sectional representation of a tubular product being formed in accordance with the present invention with a mandrel inserted therein.

Referring now to FIG. 12, in accordance with an alternative embodiment of the present invention, a cylindrical metal mandrel 16 is inserted into the workpiece before the start of the hydroforming process. Mandrel 16 has a length less than that of the final desired tubular product and a diameter substantially equal to the internal diameter of the final desired tubular product. This internal diameter will typically be close to that of the workpiece, allowing for some thickening of the walls of the final product. It is worth noting that mandrel 16 must be tubular, as shown in the drawing, and that its central cavity must further have a branch 41 opening into every branch of the die impression to allow unimpeded pressurization of all parts of the workpiece via the pressurized hydraulic fluid. In order to ensure that it is not deformed itself during the hydroforming process, mandrel 16 must have a hardness and strength at least 1.5–2.0 times that of the workpiece material when it has undergone work hardening.

Use of a mandrel 16 provides greater control and tighter tolerances for the final product internal diameter and wall thickness. In particular, it prevents thickening of the product wall opposite branches produced in the final product and thinning in the deformation zone near the branches. A further advantage in the use of a mandrel 16, for the case of large products, is to substantially reduce the volume of the pressurized hydraulic fluid in the workpiece, which, as will be understood by those familiar with the art, increases the forming process capacity.

Figure 14A:
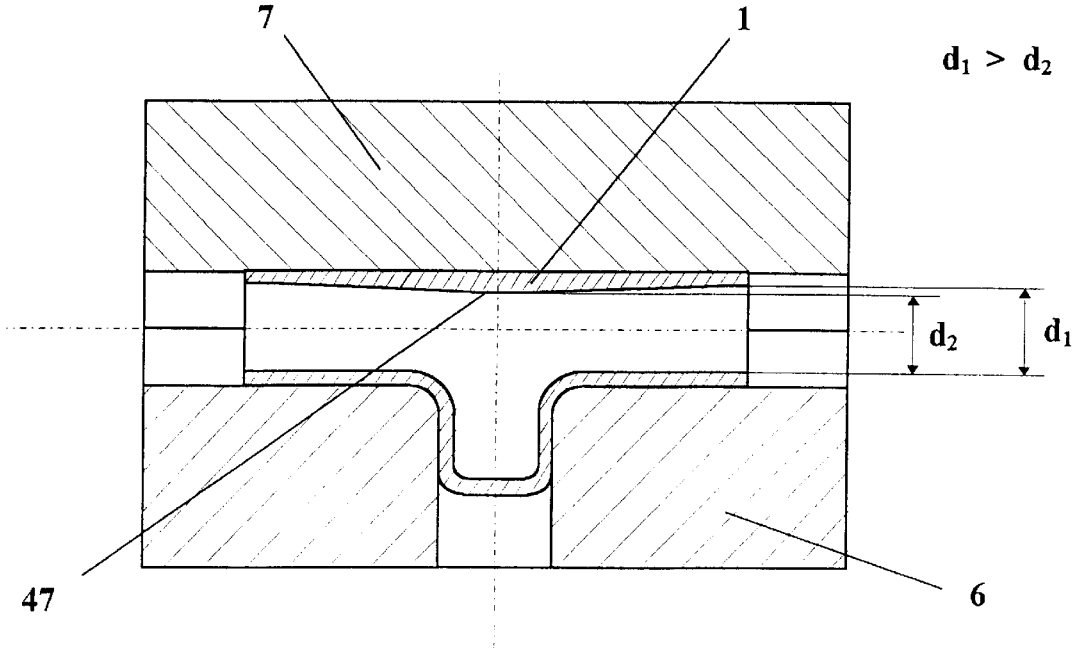
FIG. 14A is a cross-sectional view of the die and the tubular product being produced by hydroforming showing wall thickening and internal diameter non-uniformity effects.
Figure 14B:
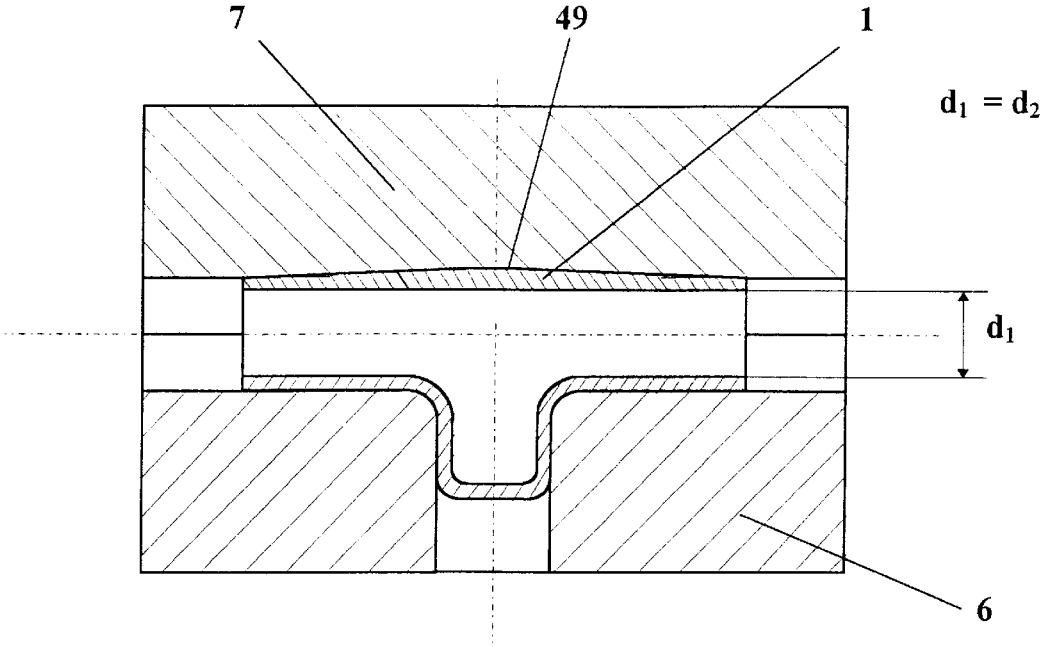
FIG. 14B is a cross-sectional view of the die and the tubular product being produced by hydroforming with correction of the effects shown in FIG. 14A.

In accordance with a further alternative embodiment of the present invention, as shown in FIGS. 14A and 14B, the shape of the cavity of die 35 may have an enhanced curvature to compensate for wall thickening 47 which is known to occur in the final tubular product when a mandrel is not employed as shown in FIG. 14A. This results in as undesirable non-uniformity in the internal diameter or cross section of the final product. As shown in FIG. 14B, this can be corrected by suitable variation 49 in the shape of the cavity of die portion 7.

It will further be appreciated, by persons skilled in the art that the scope of the present invention is not limited by what has been specifically shown and described hereinabove, merely by way of example. Rather, the scope of the present invention is defined solely by the claims, which follow.

We claim:

1. A system for forming tubular metal products from tubular workpieces including:

a base;

a split die having first and second complementary portions, which, when closed together, define a cavity with a shape corresponding to the shape of a tubular metal product desired to be formed;

an enclosing frame including a central portion arranged generally parallel to the axis of a workpiece and two lateral portions generally transverse thereto;

a clamping device mounted on said central portion of said enclosing frame operative to hold together said first and second portions of said split die with at least a predetermined force;

two setting mechanisms, each said mechanism being mounted on a preselected one of said two lateral portions of said enclosing frame symmetrically about said die and coaxially with the workpiece, each including a hydraulic setting cylinder and a setting punch, and, further, each operative to apply a setting force via said setting punch to an end of a tubular workpiece mounted in said die;

a hydraulic fluid for filling and transferring a pressure to the interior of the workpiece;

at least one hydraulic pressure amplifier operative to apply a pressure, by means of said hydraulic fluid, to the interior of the tubular workpiece via a central axial cavity in at least one of said setting mechanisms;

control apparatus operative to determine and control said setting force and said pressure, varying them in a predetermined manner, while the desired tubular product is being formed, maintaining a predetermined functional relationship between said setting force and said pressure; and a hydraulic power unit operative to activate said hydraulic setting cylinders and said at least one hydraulic pressure amplifier;

wherein the inward-facing surface of each of said setting punches is operative, when said setting force is applied thereby, to sealingly engage an end of the tubular workpiece mounted in said die so as to prevent loss of pressure of said pressurized hydraulic fluid via the ends of the workpiece, and wherein said control apparatus is operative, while the desired tubular product is being formed, to periodically reduce and increase said pressure and said setting force, thereby to increase the plasticity of the workpiece material, while maintaining said functional relationship between said pressure and said setting force.

2. A system according to claim 1 wherein said control apparatus is operative, while the desired tubular product is being formed, to periodically reduce and increase said pressure and said setting force with a periodicity in the frequency range of 3–5 Hz, and wherein said reduction is of a magnitude in the range of 20–50% of the respective magnitudes of said pressure and said force before reduction.

3. A system according to claim 1 further including torsion apparatus to apply alternating angular strains to the ends of the tubular workpiece of predetermined magnitude and frequency via said setting punches and wherein said inward-facing surfaces of said setting punches further are operative to grip the ends of the tubular workpiece so as to apply the angular strains thereto.

4. A system according to claim 3 wherein said torsion apparatus is one of the set which consists of an electromagnetic angular actuator, a hydraulic angular actuator, and a pneumatic angular actuator.

5. A system according to claim 3 wherein said angular strains are of a magnitude of at least 1 degree but no greater than 2 degrees in each direction and of a frequency in the range of 5–10 Hz.

6. A system according to claim 1 further including an ultrasound generator and at least one ultrasound transducer with a concentrator mounted in touching contact with at least one of said die and said setting punches so as to apply ultrasonic oscillations thereto and thereby, to the workpiece.

7. A system according to claim 6 wherein said ultrasound generator and said at least one ultrasound transducer are operative to supply ultrasonic oscillations of a frequency in the range 17–35 kHz, power of a magnitude less than 10 kW, and an amplitude in the range 0.1–14.0 microns.

8. A system according to claim 1 wherein said cavity of said die has extending therefrom at least one cylindrical branch protruding from the axis of the workpiece, and wherein said system further includes, for each said branch:

a hydraulic support cylinder and support punch operative to apply a support force to the workpiece as it is deformed into said branch while the desired tubular product is being formed;

wherein said control apparatus is further operative to determine and control said support force in a predetermined manner, varying it in a predetermined manner, said predetermined functional relationship further including said support force;

and wherein said control apparatus is operative, while the desired tubular product is being formed, to periodically reduce and increase said pressure, said setting force, and said support force, while maintaining said functional relationship thereamong.

9. A system according to claim 8 wherein said functional relationship is defined by the expression:

$$1.6\ P_{int}(D-2t)^2-(F_{sup}+\xi F_{set})\approx 0$$

wherein:

$P_{int}$ is said pressure applied to the interior of the workpiece, $F_{sup}$ is a weighted average sum of said support forces which is equal to zero for the case of no branches and hence, no said support force, $F_{set}$ is said setting force, $\xi$ is a shape factor which varies linearly in time from a predetermined value, depending on the shape and mechanical properties of the desired tubular product, to a value in the range of 1.1–1.4 of said predetermined value, as the desired tubular product is being formed, D is the outer diameter of the workpiece, and t is the wall thickness of the workpiece.

10. A system according to claim 8 wherein said control apparatus is operative, while the desired tubular product is being formed, to periodically reduce and increase said pressure, said setting force, and said support force with a periodicity in the frequency range of 3–5 Hz, and wherein said reduction is of a magnitude in the range of 20–50% of the respective magnitudes of said pressure and said forces before reduction.

11. A system according to claim 1 further including a mandrel mounted axially in the workpiece with an external diameter substantially matching the internal diameter of the workpiece.

12. A method for forming tubular metal products from tubular workpieces by hydroforming system including the steps of:

placing a hollow workpiece of a predetermined length within a split die;

applying a sealing pressure to ends of the workpiece;

applying a hydraulic pressure to the interior of the workpiece;

applying an axial setting force to the ends of the workpiece;

maintaining a predetermined functional relationship between at least the hydraulic pressure and the setting force;

periodically varying at least the hydraulic pressure and the setting force, while maintaining said functional relationship therebetween, at a periodicity in the frequency range of 3–5 Hz, wherein said step of varying includes the step of reducing, for a predetermined interval, the hydraulic pressure and the setting force linearly by a magnitude in the range of 20–50% of the respective magnitude of the hydraulic pressure and the setting force before said step of varying, followed by the step of increasing the hydraulic pressure and the setting force linearly to predetermined magnitudes above the respective magnitudes of the hydraulic pressure and the setting force before said step of varying, wherein said step of applying an axial setting force further includes the step of maintaining a sealing pressure on the ends of the workpiece, and wherein said steps of applying a hydraulic pressure, applying an axial setting force, and maintaining are performed substantially simultaneously.

13. A method according to claim 12 wherein a tubular metal product desired to be formed has at least one branch extending transversely therefrom, and said method also includes the step of applying to the at least one branch a support force as the at least one branch deforms from the workpiece, so as to prevent undesired thinning of the branch walls, and wherein said step of maintaining includes maintaining a predetermined functional relationship between the hydraulic pressure, the axial setting force, and the support forces and said step of varying includes varying the hydraulic pressure, the axial setting force, and the support forces.

14. A method according to claim 12 and further including the step of applying alternating angular strains to the ends of the tubular workpiece of predetermined magnitude and with a predetermined periodicity.

15. A method according to claim 12 wherein said step of applying alternating strains is applying strains of an angular magnitude of at least 1 degree but no greater than 2 degrees and with a periodicity in the range of 5–10 Hz.

16. A method according to claim 12 and further including the step of applying ultrasonic oscillations to the workpiece.

17. A method according to claim 16 wherein said step of applying ultrasonic oscillations is applying ultrasonic oscillations of a frequency in the range 17–35 kHz, power of a magnitude less than 10 kW, and an amplitude in the range 0.1–14.0 microns.

18. A method according to claim 12 wherein said functional relationship of said step of maintaining is defined by the expression:

$$1.6\, P_{int}(D-2t)^2-(F_{sup}+\xi F_{set})\approx 0$$

wherein:

$P_{int}$ the hydraulic pressure applied to the interior of the workpiece, $F_{sup}$ is a weighted sum of the support forces which is equal to zero for the case of no branches and hence, no support force, $F_{set}$ is the setting force, $\xi$ factor which varies linearly in time from a predetermined value, depending on the shape and mechanical properties of the desired tubular product, to a value in the range of 1.1–1.4 of said pre se desired tubular product is being formed, D is the outer diameter of the workpiece, and t is the wall thickness of the workpiece.

19. A method according to claim 12 further including, before said step of applying a sealing pressure, the step of immersing the workpiece in an oil bath.

* * * * *